US006300585B1

(12) United States Patent
Nicolai et al.

(10) Patent No.: US 6,300,585 B1
(45) Date of Patent: Oct. 9, 2001

(54) OPERATION COUNTER FOR A CIRCUIT INTERRUPTER

(75) Inventors: Theodore J. Nicolai; Bruce A. Biller, both of Chicago; Glenn R. Borchardt, Round Lake Beach, all of IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 09/540,650

(22) Filed: Mar. 31, 2000

Related U.S. Application Data

(60) Provisional application No. 60/128,711, filed on Apr. 8, 1999.

(51) Int. Cl.[7] ..... H01H 9/30
(52) U.S. Cl. ..... 218/1; 218/43
(58) Field of Search ..... 218/118, 120, 218/84, 78, 92, 140, 154, 1, 43, 45, 46–47, 51–54, 59, 62–64; 335/167–176

(56) References Cited

U.S. PATENT DOCUMENTS

| | | | | |
|---|---|---|---|---|
| 3,725,830 | * | 4/1973 | Rigert et al. | 335/26 |
| 3,727,019 | * | 4/1973 | Harvey | 218/154 |
| 4,855,362 | * | 8/1989 | Wainio et al. | 361/72 |
| 4,885,444 | * | 12/1989 | Lazar et al. | 200/401 |

* cited by examiner

*Primary Examiner*—Lincoln Donovan
(74) *Attorney, Agent, or Firm*—James V. Lapacek

(57) ABSTRACT

An operation counter arrangement is provided for a circuit interrupter for opening a high-voltage circuit-isolating device. The operation counter arrangement responds to actual operations via response to a moving contact arrangement of the circuit interrupter. The operation counter arrangement is capable of retrofit to existing circuit interrupters via replacement of an exhaust control device of the circuit interrupter. In a preferred arrangement, a count of both the total number of operations and the number of operations since the most recent maintenance is provided.

10 Claims, 5 Drawing Sheets

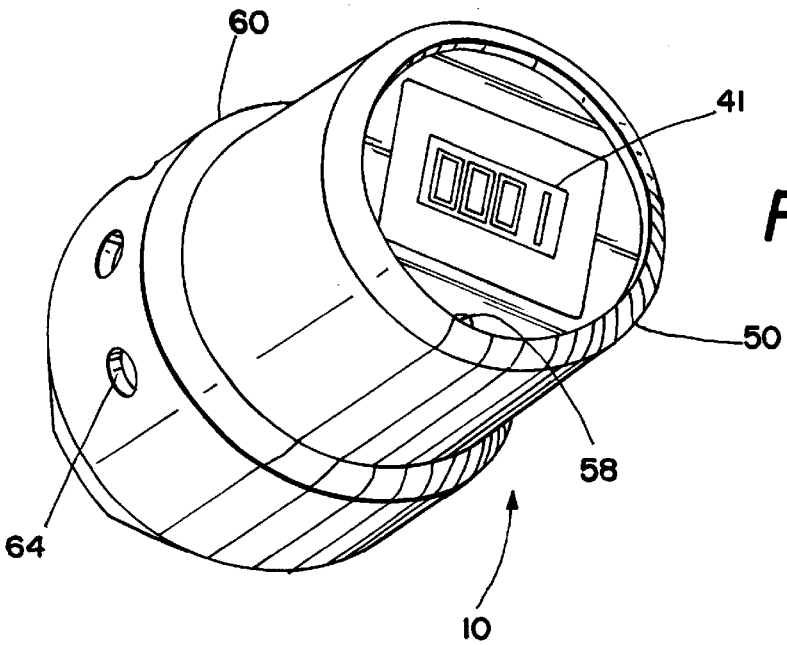
Fig. 9
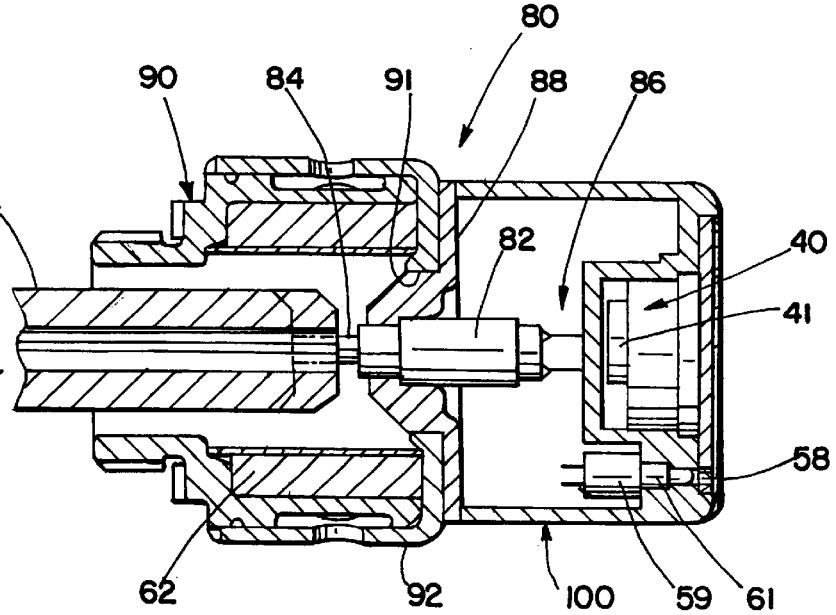
Fig. 10
Fig. 11
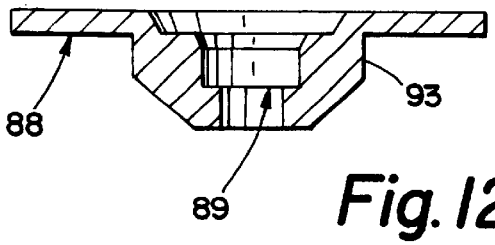
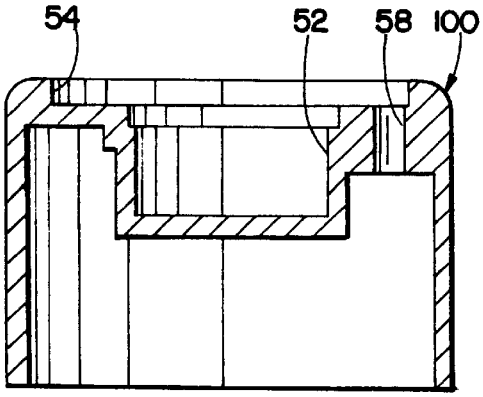
Fig. 12

OPERATION COUNTER FOR A CIRCUIT INTERRUPTER

CROSS-REFERENCE TO RELATED APPLICATIONS

This application claims benefit of Provisional Application No. 60/128,711 filed on Apr. 8, 1999.

BACKGROUND OF THE INVENTION

1. Field of the Invention

The present invention relates generally to circuit interrupters and more particularly to an operation counter for a load-current interrupting tool, commonly known as a loadbreak tool, that is utilized for opening medium and high-voltage circuit-isolating devices such as disconnecting fuses, disconnecting switches, cutouts, or the like.

2. Description of the Related Art

It is common practice in the electrical power distribution field to utilize a load-current interrupting tool, commonly known as a loadbreak tool, to open circuit-isolating devices such as disconnecting fuses, disconnecting switches, cutouts, or the like. In this manner, the circuit. isolating devices do not require load-interrupting capabilities. The loadbreak tool is carried on an insulating pole and manipulated by an operator via the pole. A load current interrupting tool of this type is the Loadbuster$^R$ Portable Loadbreak Tool available from the S&C Electric Company, Chicago, Ill. Reference may also be made to the following U.S. patents for a detailed description of a portable loadbreak tool of this general type: 2,816,978, 2,816,980, 2,816,985 and 5,650,602. A typical circuit-isolating device with which the portable loadbreak tool is utilized is illustrated in U.S. Pat. Nos. 4,414,527 and 5,502,427 and in the aforementioned U.S. Pat. No. 2,816,980. A circuit-isolating device of this type is the S&C Type XS Fuse Cutouts. When the cutout or other device, is connected in a circuit and is carrying a load current, the contacts of a movable portion (fuse tube) are in conductive engagement with respective upper and lower stationary terminals of the mounting.

The loadbreak tool includes two external, conductive attachment arrangements. A first of the conductive arrangements is arranged to selectively engage a hook-shaped anchor (commonly referred to as a Loadbuster$^R$ hook) carried by the mounting of the cutout and connected electrically to the upper stationary terminal of the mounting. The second conductive arrangement is a detachable latch member that is utilized to engage a pull ring or the like provided on the fuse tube of the cutout. The pull ring is electrically connected to the upper contact of the fuse tube. The loadbreak tool includes internal arc-interrupting facilities having separable arc-interrupting contacts which are in a closed position when the loadbreak tool is connected to the cutout. Each of the separable arc-interrupting contacts is connected to a respective one of the attachment arrangements.

The loadbreak tool provides for relative movement between the two attachment arrangements while also providing a conductive path between the stationary terminal of the mounting and the upper terminal of the fuse tube via the pull ring. When the operator pulls downward on the pole, the fuse tube pivots away from the cutout mounting and in the initial stages of opening the fuse tube, the load current path is maintained through the separable contacts of the loadbreak tool. After the continued opening of the fuse tube of the cutout has caused appropriate relative motion between the two attachment arrangements of the loadbreak tool, the arc-interrupting contacts are opened such that load interruption takes place internally of the loadbreak tool. Next, the loadbreak tool is detached from the cutout and removed from the vicinity of the cutout. A manually operable resetting latch arrangement is then manipulated by the operator to permit resetting of the loadbreak tool for subsequent use. The resetting of the loadbreak tool closes and resets the separable arc-interrupting contacts, returns the conductive attachment arrangements to their initial positions, and resets an internal trigger mechanism.

The operating life of the loadbreak tool depends upon the number of operations and the severity of the switching duties. Based on typical usage, involving an intermixture of varied switching duties, 500–1000 operations may normally be expected between required inspections. During such periodic inspections, various internal parts are inspected. Based on such inspection, reconditioning is accomplished as required including the replacement of various parts. Since the number of operations between typical inspections is large and there are no audible or visual signals that indicate the need for replacement of worn component parts, the number of operations should be accumulated and kept track of. However, since it is difficult to accurately keep track of the actual number of operations, the scheduling of maintenance is not always accurate, i.e. maintenance may be more frequent than typically required or may be unintentionally delayed until a problem is noticed.

SUMMARY OF THE INVENTION

Accordingly, it is a principal object of the present invention to provide an operation counter for a load-current interrupting tool to improve the scheduling of maintenance and inspection.

It is another object of the present invention to provide a count of total operations and the number of operations since the most recent maintenance.

These and other objects of the present invention are efficiently achieved in a circuit interrupter through the provision of an operation counter. The operation counter responds to actual operations via response to a moving contact arrangement of the circuit interrupter. The operation counter arrangement is capable of retrofit to existing circuit interrupters via replacement of an exhaust control device of the circuit interrupter. In a preferred arrangement, a count of both the total number of operations and the number of operations since the most recent maintenance is provided.

BRIEF DESCRIPTION OF THE DRAWING

The invention, both as to its organization and method of operation, together with further objects and advantages thereof, will best be understood by reference to the following specification taken in conjunction with the accompanying drawing in which like reference numerals refer to like elements and in which:

FIG. 9 is a perspective view of the overall operations counter arrangement of FIGS. 1–3;

FIG. 10 is an elevational view, partly in section and with parts removed and cutaway for clarity, of an alternate embodiment of an operation counter arrangement of the present invention;

FIG. 11 is an adapter component of the operation counter arrangement of FIG. 10;

FIG. 12 is a sectional view of a first subassembly of the operation counter arrangement of FIG. 10;

DETAILED DESCRIPTION

Figure 1:
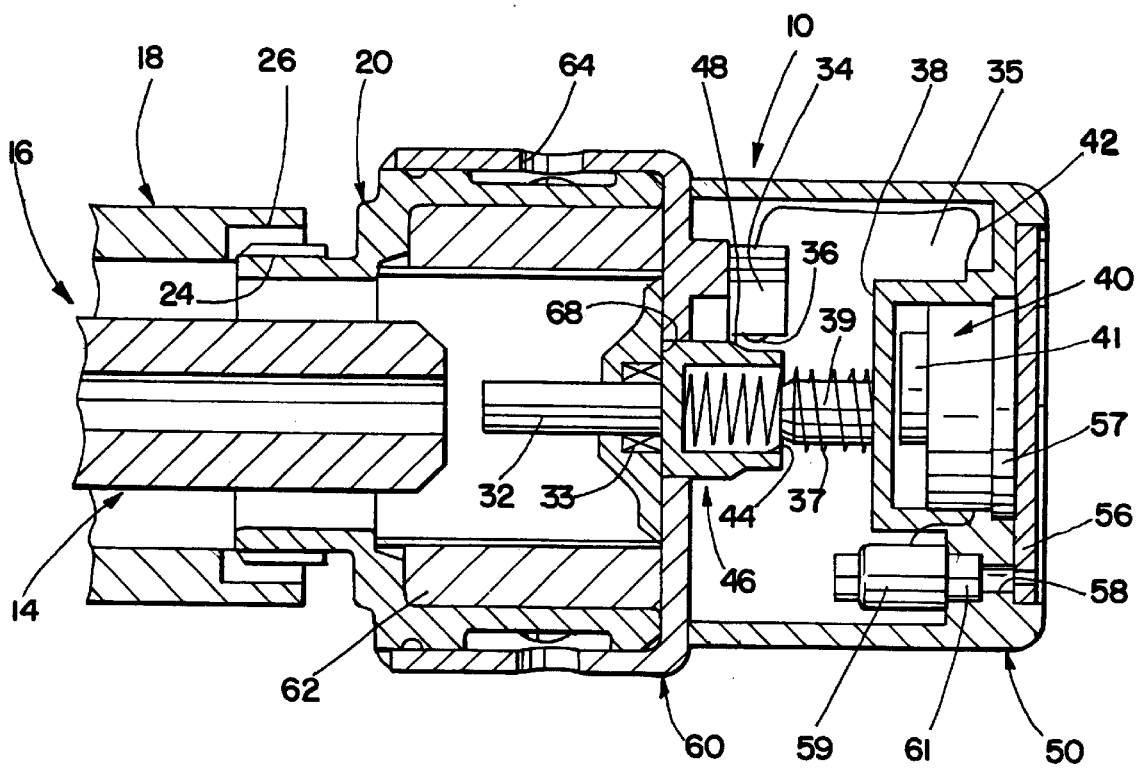
FIGS. 1–3 are elevational views, partly in section and with parts removed and cutaway for clarity, of an operation counter arrangement of the present invention assembled to a loadbreak tool and illustrating various operational modes.

Referring now to FIGS. 1–3 and 9, an operation counter arrangement 10 of the present invention is shown in conjunction with a trailer portion 14 of a movable contact assembly generally referred to at 16 of an illustrative circuit interrupter, hereafter loadbreak tool 18, e.g. a portable load-current interrupting tool, e.g. the Loadbuster$^R$ tool available from S&C Electric Company as described in more detail in the Background section. During operation to interrupt a circuit and open a fuse cutout or the like, the trailer portion 14 moves to the left in FIG. 1 whereupon the loadbreak tool 18 internally opens the circuit and interrupts load current. In a specific arrangement, the trailer portion 14 is fabricated from arc-extinguishing material. The loadbreak tool 18 includes an exhaust control assembly 20 and a tube assembly 22 which are assembled via respective threaded portions 24, 26. Accordingly, the operation counter arrangement 10 may be affixed to the loadbreak tool 18 as incorporated onto the exhaust control assembly 20 or via the assembly of the operation counter arrangement 10 onto the existing exhaust control device 20 as illustrated. The operation counter arrangement 10 responds to the movement of the trailer portion 14 during operation thereof in the loadbreak tool 18.

Figure 2:
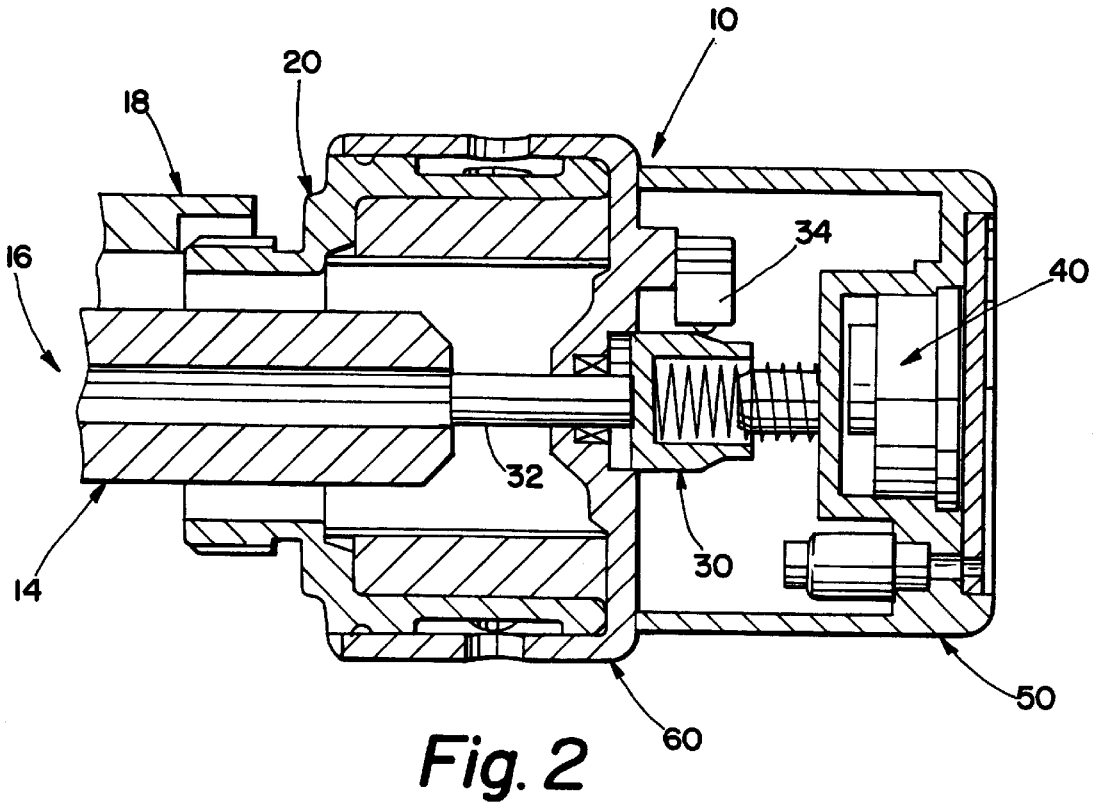
Figure 3:
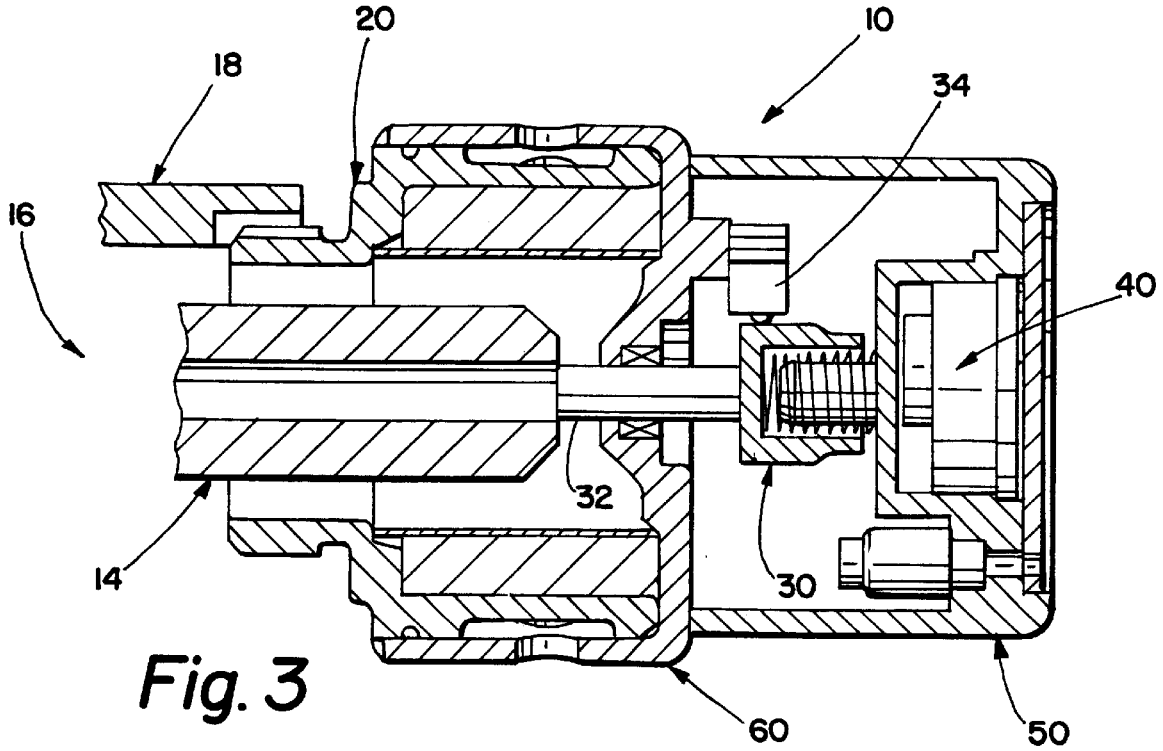

After circuit-opening operation, the loadbreak tool 18 is reset for another operation by closing the loadbreak tool 18 whereupon the trailer portion 14 of the movable contact assembly 16 is moved to the right in FIG. 1 and through the positions illustrated in FIGS. 2 and 3. In a specific embodiment, the operation counter arrangement 10 includes an actuator 30 having an extending portion 32 that is contacted by the trailer portion 14. For example, as the trailer portion 14 moves to the right from FIGS. 1–3, it moves the actuator 30 to the right from the position of FIG. 2 to the position of FIG. 3 as the trailer portion 14 moves as shown in FIG. 3 with the loadbreak tool 18 being in the closed position and reset for another operation. In a specific arrangement, as the actuator 30 moves to the position of FIG. 3, it actuates an operation counter switch 34 via contact with a switch actuator 36 to increment the operation count. When the loadbreak tool 18 is next operated, the trailer portion 14 moves to the left, from the closed, reset position of FIG. 3 to the position in FIG. 1. Subsequent resetting of the loadbreak tool 18 results in an additional actuation of the operations counter switch 34. In another specific arrangement, the operation counter switch 34 is actuated via the switch actuator 36 to increment the operation count as the trailer portion moves to the left from the position of FIG. 3 and through the positions of FIGS. 2 and I as the loadbreak tool is operated during a circuit-opening operation.

Figure 8:
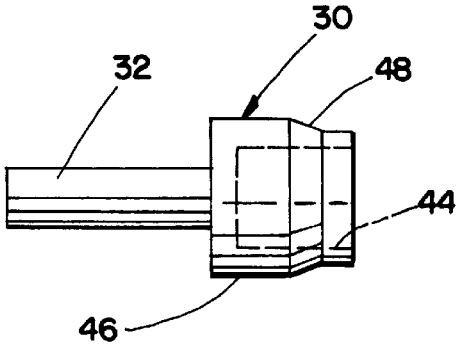
FIG. 8 is an elevational view of an actuator of the actuator assembly of the second subassembly of FIG. 5.

The actuator 30 is biased to the left in FIGS. 1–3 by a compression spring 37 that is arranged to act between the actuator 30 and a wall 38 that extends from a cap assembly 50 of the operations counter arrangement 10. The spring 37 is arranged about a post 39 extending from the wall 38. Thus, when the trailer portion 14 moves to the left from FIGS. 3 to 1, the actuator 30 follows the portion 14 and stops in the position shown in FIG. 1. With additional reference to FIG. 8, the spring 37 is received within a central cavity 44 of a widened portion 46 of the actuator 30. The outer surface of the widened portion 46 includes a ramp surface 48 for actuating the switch actuator 36 of the operation counter switch 34. The cap assembly 50 is affixed to a cover 60 of the operation counter arrangement 10. The cover 60 is arranged to interfit with the exhaust control assembly 20. The exhaust control assembly 20 houses a toroidal screen assembly 62 through which exhaust gases pass during circuit interruption to exit the exhaust control assembly 20 via openings 64 in the cover 60.

The operation counter arrangement 10 includes a counter, associated electrical circuitry and a display assembly referred to generally at 40, with display element at 41. Electrical connections referred to at 42 connect the display assembly 40 to the operations counter switch 34 so as to provide a signal to the display assembly 40 to advance the operations count.

Figure 4:
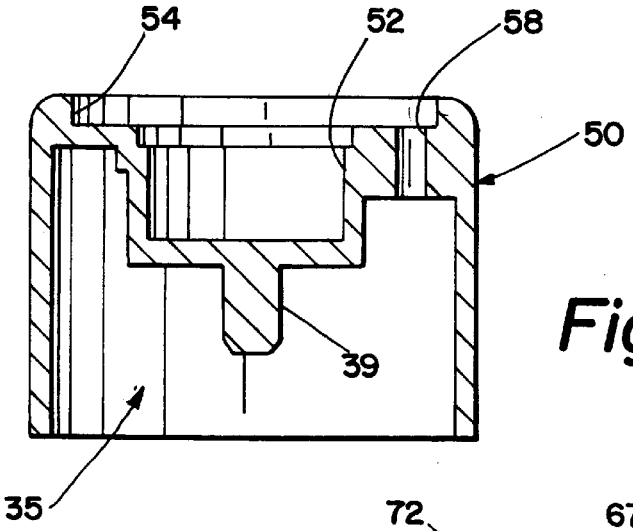
FIG. 4 is a sectional view of a first subassembly of the operation counter arrangement of FIGS. 1–3 that incorporates the counter and associated circuit components.

With additional reference now to FIG. 4, the cap assembly 50 is a generally hollow cylindrical shell. The top of the cap assembly 50 defines a cavity 52 for receiving the display assembly 40 of the counter, circuitry and display element. A circumferential recess 54 is also defined in the top of the cap assembly 50. As shown in FIG. 1, a circular cover plate 56 of transparent material is affixed in the recess 54, through which the display element 41 of the display assembly 40 may be viewed to ascertain the operations count, e.g. "0848" representing 848 total operations. In a preferred embodiment, an inside transparent cover 57 is also provided over the cavity 52 to provide additional sealing to and protection of the display assembly 40. A passage 58 is provided through the top of the cap assembly 50. As seen in FIGS. 1–3, in one specific embodiment, a reset switch 59 is provided that is accessible via the passage 58 and includes a reset actuator 61. Actuation of the reset switch 59 via the reset actuator 61 provides a reset signal to the display assembly 40 over electrical connections 63. In a preferred embodiment, the reset signal is utilized to reset a lap count representing the count since the last maintenance/overhaul or the like while the assembly also maintains an accumulated count of total operations. For example, the display 41 indicates both the total number of operations, e.g. "848" and the number of operations since the most recent maintenance/overhaul procedure, e.g. "348" corresponding to the loadbreak tool 18 having an overhaul at 500 operations.

Figure 5:
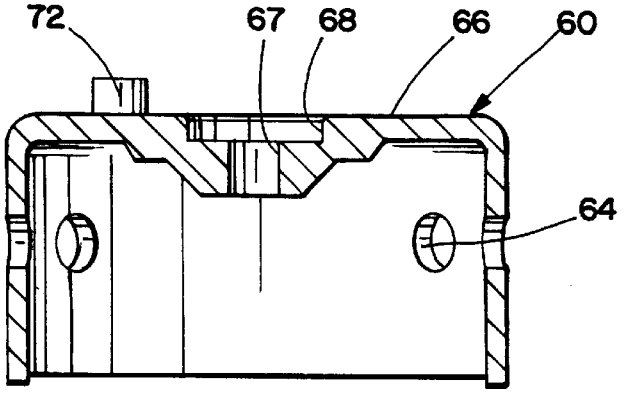
FIG. 5 is a sectional view of a second subassembly of the operation counter arrangement of FIGS. 1–3 that incorporates an actuator assembly for the operation counter and also functions as an exhaust control device that is assembled onto the loadbreak tool.
Figure 6:
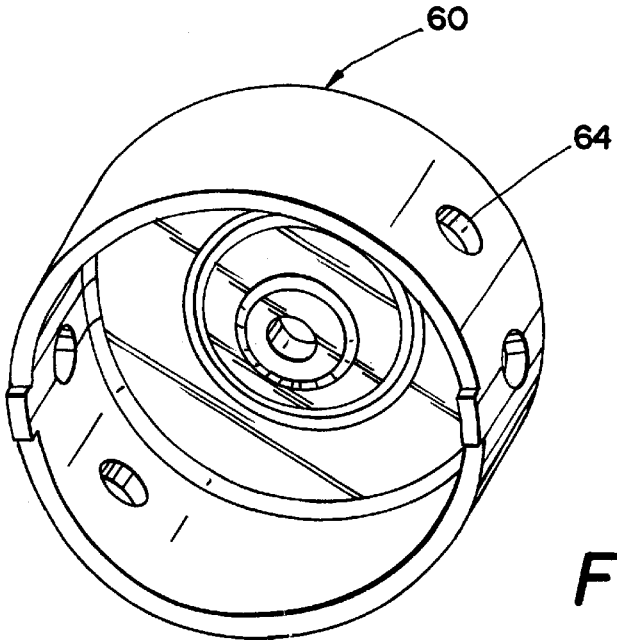
FIGS. 6 and 7 are perspective views of the second subassembly of FIG. 5 illustrating various features thereof.
Figure 7:
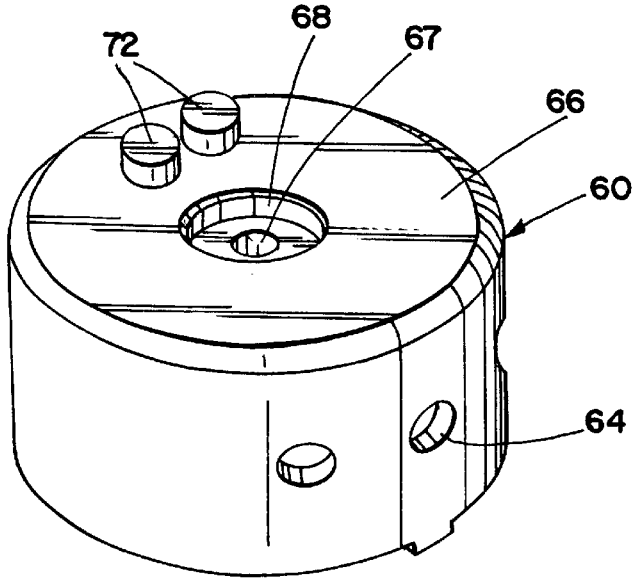

With additional reference now to FIGS. 5–7, the cover 60 is a generally hollow cylindrical shell having a top portion 66 that defines a central opening 67 for passage of the extending portion 32 of the actuator 30. A recess 68 is also provided around the opening 67 for receiving the widened portion 46 of the actuator 30. As seen in FIGS. 1–3, in a preferred embodiment, the central opening 67 includes a sealing arrangement at 33 that cooperates with the extending portion 32 to seal the gases that may be generated in the exhaust control assembly 20 from passing into the interior 35 of the cap assembly 50. In other embodiments, the sealing arrangement may be provided at the base of the recess 68 either alternatively or additionally to the sealing arrangement 33. The cover 60 fits over the inner portions of the exhaust control assembly 20 and is affixed thereto. Projections 72 on the top 66 of the cover 60 are arranged to support the operations counter switch 34. To provide electromagnetic shielding to the circuitry and components of the display assembly 40, the cap assembly 50 and/or the cover 60 are molded from a conductive plastic or the like, or alternatively, coated with a conductive film.

Considering now an alternate embodiment of the operations counter of the present invention and referring now additionally to FIGS. 10–12, an operations counter arrangement 80 is shown that includes an actuator switch assembly 82 having a switch actuator 84 that is biased outwardly toward the trailer portion 14 so as to be driven thereby. In operation, the actuator switch assembly 82 is actuated when the trailer portion 14 and the switch actuator 84 moves from the phantom position in FIG. 10 to the solid position as shown in FIG. 10, similarly to the discussion in conjunction with FIGS. 1–3. Accordingly, the switch actuator assembly 82 at output leads 86 provides input signals to the electrical circuit and display assembly 40 to increment the display 41. The actuator switch assembly 82 is carried by a base plate or member 88 at the base of a cap assembly 100. The base plate 88 is affixed to a cover 92 of the operation counter arrangement 80 that is arranged to interfit with an exhaust control assembly 90 (the details of the base plate 88 being illustrated in FIG. 11). Alternatively, the base plate 88 and the cover 92 are molded integrally. The cover 92 includes a central opening 91 which cooperates and interfits with a shoulder portion 93 (FIG. 11) of the base plate 88. The exhaust control assembly 90, as discussed hereinbefore in connection with the exhaust control assembly 20 houses a toroidal screen assembly 62 through which exhaust gases pass during circuit interruption to exit the exhaust control assembly 20 via openings 64 in the cover 92. The base plate 88 supports an affixed cap assembly 100, the cap assembly 100 housing the actuator switch assembly 82 and the electrical circuit and display assembly 40 (the details of the cap assembly 100 being illustrated in FIG. 12). As best seen in FIG. 11, the base plate 88 includes a central opening at 89 for receiving the actuator switch assembly 82. As best seen in FIG. 12, cap assembly 100 includes a cavity 52 for receiving the display assembly of the counter, circuitry and display element. A circumferential recess 54 is also defined in the top of the cap assembly 100. A passage 58 is provided through the top of the cap assembly 100 for resetting the reset switch 59 (FIG. 10) via the reset actuator 61.

Figure 13:
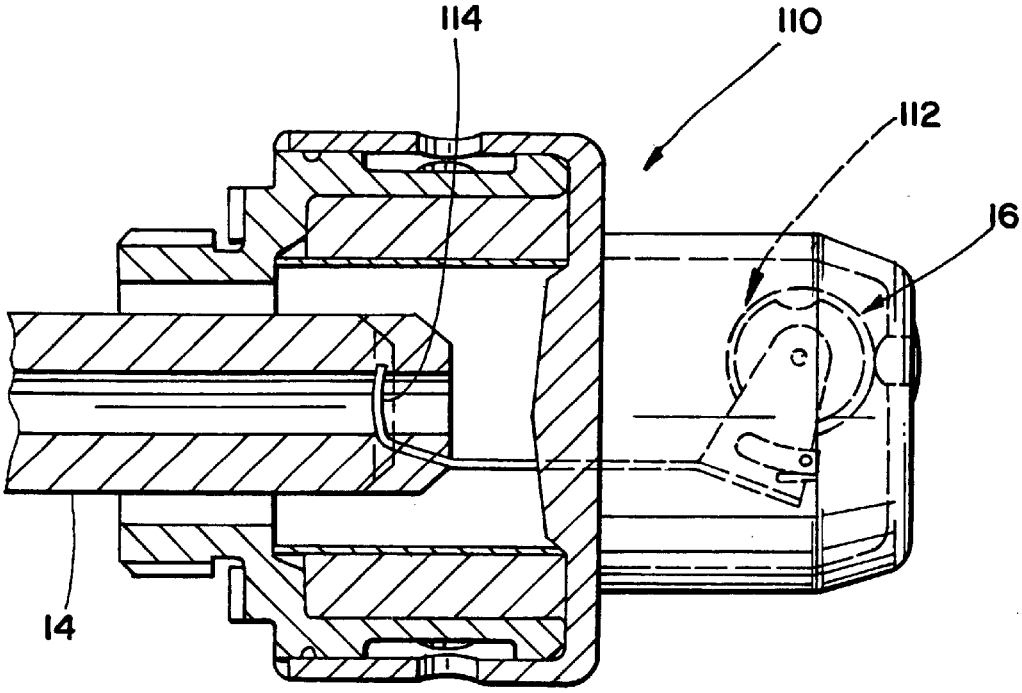
FIG. 13 is an elevational view, partly in section and with parts cut away for clarity of another embodiment of the operation counter arrangement of the present invention.

In accordance with another embodiment of the present invention and with additional reference now to FIG. 13, an operation counter arrangement 110 includes a mechanical counter/display device 112 that is actuated via actuator arm 114 by the trailer portion 14 and provides a display at 116.

Figure 14:
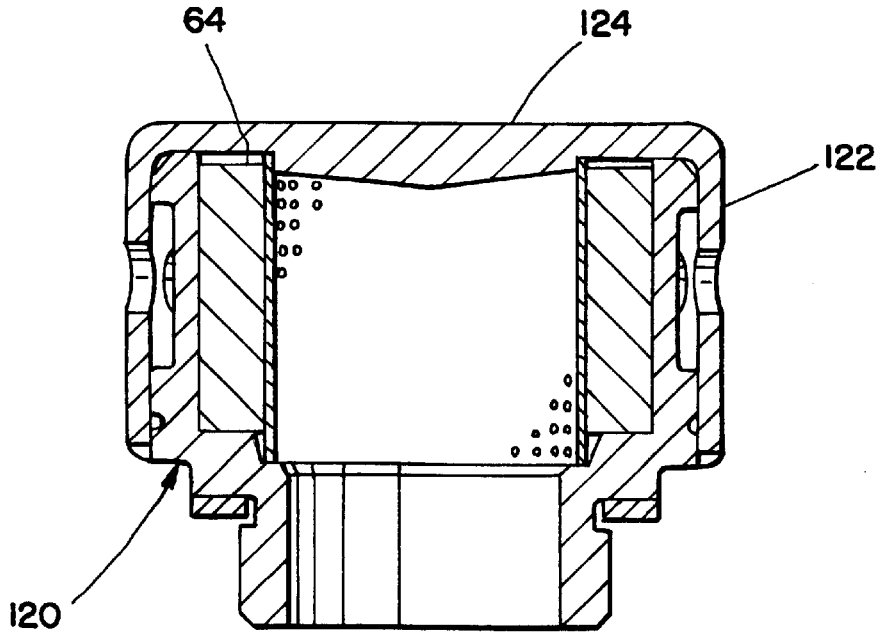
FIG. 14 is an elevational view, partly in section and with parts removed for clarity of an exhaust control device of the type illustrated in FIGS. 1–3 and 10 as implemented for loadbreak tools without the operations counter feature of the present invention.

Referring now additionally to FIG. 14, an exhaust control assembly 120 is illustrated that is suitable for use with a loadbreak tool as discussed hereinbefore without the provisions of the operation counter arrangements 10, 80 and 110. For example, the exhaust control assembly 120 is similar in internal construction to the exhaust control assemblies 20 and 90 but includes a cover 122 with a solid top surface 124. In order to retrofit loadbreak tools 18 that are not equipped with the operation counter arrangement 10, 80 or 110, the existing exhaust control assembly such as 120 or prior available assembly is removed and the exhaust control assembly 20 or 90 with the operations counter arrangement 10, 80 or 110 is assembled onto the loadbreak tool. Alternatively, the cover 122 is removed from the exhaust control assembly 120, and the operation counter arrangement 10, 80 or 110 is assembled onto the exhaust control assembly 120 with the cover 60 or 92 being affixed to the exhaust control assembly 120.

While there have been illustrated and described various embodiments of the present invention, it will be apparent that various changes and modifications will occur to those skilled in the art. For example, in other specific embodiments, instead of being actuated by direct contact of the trailer portion, the operation counter arrangement 10 is arranged to sense the movement or proximity of the movable contact assembly 16 or the like. It is intended in the appended claims to cover all such changes and modifications as fall within the true spirit and scope of the present invention.

What is claimed and desired to be secured by Letters Patent of the United States is:

1. An operation counter arrangement for use with a circuit interrupter having a movable contact member and a predetermined housing portion of an exhaust control device adjacent the movable contact member, the operation counter arrangement comprising:

first means for assembling the operation counter arrangement to the predetermined housing portion of the circuit interrupter, said first means comprising a cover comprising means to interfit with the predetermined housing portion of said exhaust control device; and second means responsive to the movable contact member for counting the number of operations of the circuit interrupter via the movement of the movable contact member.

2. The operation counter arrangement of claim 1 wherein said second means comprises actuator means being arranged to be contacted by the movable contact member.

3. The operation counter arrangement of claim 2 wherein said second means further comprises third means responsive to said actuator means for maintaining and incrementing an operation count.

4. The operation counter arrangement of claim 3 wherein said second means further comprises display means for displaying said operation count.

5. The operation counter arrangement of claim 3 wherein said third means further comprises fourth means for maintaining and incrementing a lap count.

6. The operation counter arrangement of claim 5 wherein said second means further comprises fifth means responsive at an input for resetting said lap count of said third means.

7. The operation counter arrangement of claim 3 wherein said third means comprises a switch having an actuator responsive to said actuator means.

8. The operation counter arrangement of claim 1 further comprising third means for housing said second means, said third means comprising a first wall, said second means comprising fourth means arranged to be actuated by the movable contact member, said fourth means including a movable actuator member that extends through said first wall, said movable actuator member being contacted by the movable contact member on a first side of said first wall, said second means further comprising fifth means located on the second side of said first wall and being responsive to said movable actuator member for maintaining and displaying an operation count.

9. An operation counter arrangement for use with a circuit interrupter having a movable contact member and a predetermined housing portion adjacent the movable contact member, the operation counter arrangement comprising:

first means for assembling the operation counter arrangement to the predetermined housing portion of the circuit interrupter; and second means responsive to the movable contact member for counting the number of operations of the circuit interrupter via the movement of the movable contact member, wherein the circuit interrupter includes a predetermined exhaust control device that assembles onto the predetermined housing portion, said first means further comprising the predetermined exhaust control device.

10. The operation counter arrangement of claim 9 further comprising third means for housing said first and second means.

* * * * *